US006621890B1

(12) United States Patent
Rondeux

(10) Patent No.: US 6,621,890 B1
(45) Date of Patent: Sep. 16, 2003

(54) METHOD FOR CONTROLLING AN IONIZING RADIATION GENERATOR AND IMPLEMENTING INSTALLATION

(75) Inventor: Christian Rondeux, Liege (BE)

(73) Assignee: Balteau NDT, Herve (BE)

( * ) Notice: Subject to any disclaimer, the term of this patent is extended or adjusted under 35 U.S.C. 154(b) by 0 days.

(21) Appl. No.: 09/831,809

(22) PCT Filed: Nov. 9, 1999

(86) PCT No.: PCT/BE99/00143

§ 371 (c)(1),
(2), (4) Date: May 11, 2001

(87) PCT Pub. No.: WO00/30416

PCT Pub. Date: May 25, 2000

(30) Foreign Application Priority Data

Nov. 13, 1998 (EP) ..... 98870253

(51) Int. Cl.[7] ..... H05G 1/08
(52) U.S. Cl. ..... 378/114; 378/91
(58) Field of Search ..... 378/114–117, 91

(56) References Cited

U.S. PATENT DOCUMENTS 3,747,054 A * 7/1973 Arvanetakis ..... 378/117
4,170,735 A 10/1979 Codina et al.
5,077,831 A 12/1991 Weber
5,081,543 A 1/1992 Romandi
5,631,943 A * 5/1997 Miles ..... 378/117

FOREIGN PATENT DOCUMENTS

| | | |
|---|---|---|
| CN | 1087171 | 5/1994 |
| DE | 196 43 641 A1 | 10/1996 |
| DE | 197 04 708 A1 | 2/1997 |
| EP | 0 037 238 | 10/1981 |
| JP | 9238962 | 9/1997 |
| WO | WO 95/33328 | 12/1995 |
| WO | WO 96/37063 | 11/1996 |

* cited by examiner

*Primary Examiner*—Craig E. Church
(74) *Attorney, Agent, or Firm*—Knobbe Martens Olson & Bear LLP

(57) ABSTRACT

The invention concerns a method for controlling an ionizing radiation generator (2) which consists in setting up a connection by radio relay channel between the generator and the control device (1). The invention is characterised in that said connection consists in transmitting a code specific to the generator and a code for connecting it to the control device and in communicating the two codes at each connection between said generator and said control device. The invention also concerns the installation for implementing said method.

28 Claims, 1 Drawing Sheet

METHOD FOR CONTROLLING AN IONIZING RADIATION GENERATOR AND IMPLEMENTING INSTALLATION

RELATED APPLICATIONS

This application filed Nov. 9, 1999, is a § 371 filing of PCT/BE99/00143, which takes priority from EP 98870253.6, filed Nov. 13, 1998.

1. Subject of the Invention

The present invention relates to a process for controlling an ionizing radiation generator.

The present invention also relates to the installation for carrying out this process.

2. Technological Background

Devices for generating X rays, alpha rays, gamma rays or other ionizing rays (or radiation) require a control panel which must be placed a sufficient distance away from the source of radiation in order to avoid any danger of excessive irradiation of the operator.

This is particularly true in the field of industrial non-destructive testing by ionizing radiation. In this case, the device is used "in situ", for example in a factory or at a work site, that is to say in an environment which varies according to the application.

An X-ray generator, for example, may be a monobloc device or may consist of separate components (power unit, high-voltage cable, X-ray tube) Generally, the control panel is connected to the generator via an electric cable whose length is such that it allows the operator to be far enough away from it.

Often, the length of the cable thus serves as a reference to the operator or installer to know the safe distance at which the operator should be placed.

However, the physical need for this cable may be a major handicap for the operator and/or for other individuals, who may possibly find themselves within the safety distance of the generator.

This is especially the case when the arrangement of other objects at the work site, for example during the checking of welds by X-ray, prevents the operator from maintaining an overall view in the hazard radius around the generator he is controlling. The operator would therefore not always have the possibility of stopping the generator to prevent other individuals from being placed in danger.

Moreover, no device generally prevents the operator from erroneously placing the control panel an insufficient distance away from the generator. He is even prevented from doing so when the arrangement at the site of use does not allow the cable to be extended in a straight line so that it marks the safe distance for him.

The prior art mentions remote-control devices which allow, for reasons of safety or of convenience of use, the operator or user to be distant from the area in which the devices, which may be hazardous, are operating.

Thus, document JP-A-09238962 discloses a diagnostic and treatment system in the field of dentistry. Flows of electronic data are exchanged between a data storage device and various diagnostic devices, including a dental X-ray generator, and treatment devices located in the vicinity of one or more patients. The data exchange is orchestrated by an input/output controller, which is remote-controlled by means of a wireless transmitter/receiver system. The aim of the invention is to make it easier for a dentist or his assistant to manage the data. However, the X rays used in dentistry are of low energy (<70 keV) and the invention does not per se satisfy the safety needs required when working at a work site with ionizing radiation generators whose energy may be, in certain cases, several MeV. Furthermore, the remote control device may be used to control more than one device or instrument.

Also in the medical field, the remote control of a diagnostic installation which can generate ionizing radiation has been disclosed (U.S. Pat. No. 5,081,543). To solve the problem of safety in the event of disruption or interruption of the control signal, it has been proposed to use two data carrier signals simultaneously, such as, for example, an infra-red signal and an ultra-sound signal. Such a device is complex, expensive and relatively unsuitable for an industrial work site environment.

In the field of checking faults, document CN-A-1 087 171 discloses a remote-control device fitted with a transmitter/receiver for remotely controlling an X-ray generator. Although the said invention is intended to protect the operator, nothing is disclosed regarding the operating procedure or the special advantages of the present application.

The remote-control or digital radio-frequency control of electronic equipment is well-known. Document EP-A1-037 238 presents the use of a digital-frequency radio transmitter/receiver system for remotely controlling an industrial appliance. Such an installation allows the operator to save time, where appropriate, by allowing better vision, increased mobility or a more advantageous position. As regards the safety aspect, it allows the operator to be removed from the hazard zones. Transmission checking means are used throughout the said transmission (use of control channels, generation and comparison of parity bits and of identification code).

WO-A-96/37063 presents a secured encrypted radio-frequency transmission, for example for an application such as in opening a garage door. Safety is ensured by means of operations on a code which has a fixed portion and a variable portion. The signal transmitted is amplitude-modulated, demodulated by the receiver and the initial code is restored.

It is also possible, as in WO-95/33328, to radio-control a switching device, with a control unit which simultaneously sends via the transmitter a code specific to the receiver and a code specific to the device to be controlled. The control data is supplied by the user to the control unit by means of a telephone network (touch-key telephone).

In document U.S. Pat. No. 5,077,831, a safety device consists of a transmitter of a high-frequency signal modulated to a code word signal and of a receiver which has an alarm system. In order to protect the transmitter against any unauthorized use, the said transmitter is provided with a switching system with a memory for entering the code words and an input unit for introducing a password. This password is compared in a comparator with the code words in the memory. If there is a match, the transmission is authorized and the alarm may be actuated.

3. Aims of the Invention

The present invention is directed towards proposing a process for controlling an ionizing radiation generator which ensures a very high level of safety, avoids the aforementioned drawbacks and provides other advantages which will be described below.

A further aim of the present invention is to propose an installation for carrying out this process, which provides many advantages as regards work site safety and management.

MAIN CHARACTERISTIC ELEMENTS OF THE INVENTION

Figure 1:
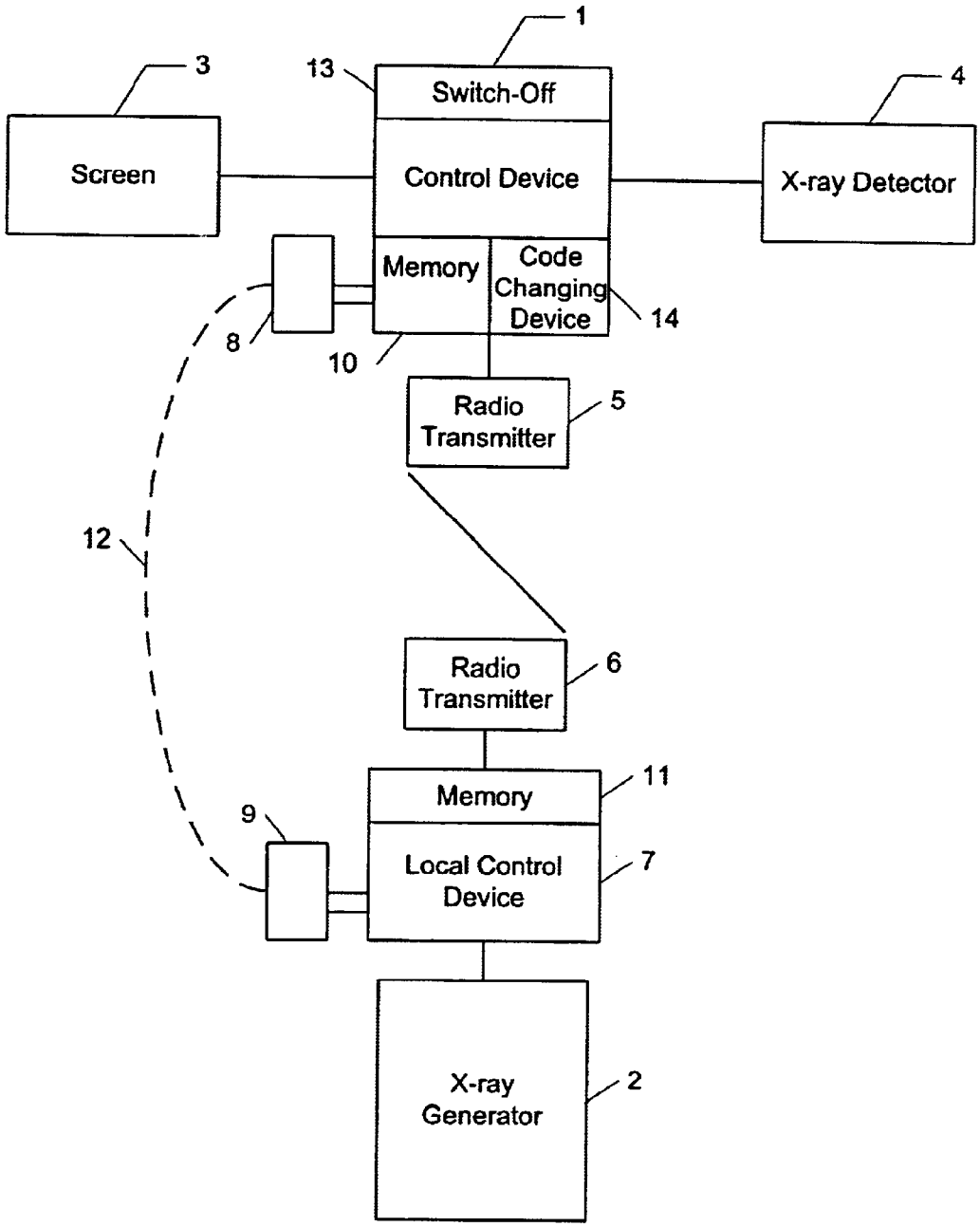
FIG. 1 diagrammatically represents the generator control device according to the invention.

The present invention relates to a process for controlling an ionizing radiation generator, in which a radio relay connection is set up between the generator and a remote-control device associated with the generator, which is called hereinafter more briefly control device.

As a result, the operator has the possibility of positioning his control panel so as to have a general view of the environment of the generator, in order to intervene should other individuals enter the hazard zone around the generator.

Moreover, the operator is not prevented, by the length of a cable, from placing himself a safe distance away in the event that certain objects do not allow the cable to be arranged in a straight line if the length of this cable is equivalent to the said safe distance.

According to the invention, the connection between the generator and the control device comprises the transmission of a code specific to the generator and of a code specific to its connection with the control device and the communication of these two codes to the generator at each connection between the generator and the control device. This makes it possible to set up a univocal connection, that is to say that the control device cannot control another generator and that the generator cannot be controlled by another control device, as long as the set of the two codes is not changed.

Advantageously, once the connection has been set up after recognition of the codes establishing a univocal relationship between the generator and the control device, the said radio relay connection is kept on permanently while the generator is working, and in particular during the emission of ionizing radiation.

The radio relay connection may, however, be interrupted, even very briefly, for any reason (too great a distance between the operator and the local control device, presence of an obstacle, poor quality of the transmission, false maneuver, remote-control device dropped and damaged, etc.). In this case, in a particularly advantageous manner, the generator stops emitting radiation and goes into safe mode.

According to one preferred embodiment of the invention, the code specific to the connection of the control device is changed at each connection of the generator with another control device. There is thus the possibility of controlling a generator with another control device, in particular when the control device used breaks down. Moreover, it is no longer necessary, when installing a work site, to ensure that the control device which was used previously with the generator is selected.

Advantageously, the code specific to the connection with the control device, at each connection with another control device, is changed according to the same mathematical rule. By this means, there is the possibility, by consulting the current code and comparing it with the initial code, of determining the number of changes that have taken place.

According to another preferred embodiment, the changing of the code specific to the connection with the control device consists of incrementation by adding a given number. This use of an incremental number is the simplest method, but is generally sufficient to carry out the said change and to make possible any determination of the number of changes that have taken place.

Furthermore, it is advantageous that the code specific to the connection with the control device should comprise not only a variable portion, but also a fixed portion specific to the control device. In this case, for example, by taking all or a given portion of the manufacturing number of the control device as the fixed portion, it is possible in a simple manner to prevent a generator, which is a reasonable distance away from another generator, from erroneously receiving instructions from the control device assigned to this other generator, which would especially arise if the two control devices had at a given moment the same incremental number and if the other control device still had in its memory the code for the first generator which it had previously controlled.

According to one embodiment of the invention, any connection between the generator and the control device is set up by radio relay. With radio transmission means present, the need for and the possible drawbacks of another mode of transmission, for example by cable, are thus avoided.

Preferably, the generator initially communicates the two codes to the control device during a pairing which is carried out at the time of setting up a new generator/control device couple. By avoiding human intervention in the initial communication of the codes, the safety is enhanced by avoiding errors which may arise during the manual transmission of the codes.

It is thus preferred to give the pairing instruction by means of a signal which is produced by the fact of placing the control device close to the local control device of the generator. The expression "local control device of the generator" means the portion of the generator, sometimes known as the case, which may in particular contain the power supply for the generator, the radio transmitter and in general the electrical control members which do not necessarily need to be in the very place at which the radiation is produced. By temporarily placing the control device close to the local control device of the generator, there is the possibility of bringing about pairing by various means, such as a contact actuated by the fact that the two devices touch each other.

The pairing is advantageously achieved by connecting the control device of the invention to the local control device of the generator. At this point, the distance of the two devices is irrelevant and the connection itself may possibly bring about the initial communication of the two codes.

Preferably, the transmission between the generator and the control device, with the exception of the initial communication of the pairing, is made inoperative if the codes do not match those of the pairing or if the transmission is cut, even very briefly, for any reason (false maneuver, too great a distance between the operator and the control panel, remote-control device dropped and damaged, etc.). The term "transmission" means both transmission from the generator and transmission to it. It is this means which provides the best guarantees that only the messages specific to the control device/generator couple are taken into account, although there is nevertheless the possibility of keeping these guarantees when another control device is assigned to a generator or another generator is assigned to a given control device.

Advantageously, when the generator is working, the magnitude of the radiation close to the control device is measured, in order to know the dose of radiation received by the operator. It is then advantageous for a warning signal to be emitted when the dose exceeds a given level. In point of fact, this is the means in particular for preventing the control device from being erroneously placed not far enough away from the generator.

Furthermore, it is preferred that, when the radiation reaches a hazard level, the radiation-measuring device causes the generator to be switched off. The safety is thus optimal.

The present invention also relates to an installation for carrying out the process, conventionally comprising an ionizing radiation generator and a remote-control device.

According to the invention, the generator and the remote-control device are each equipped with a radio transmitter and a memory for recording and transmitting a generator code and a code specific to its connection with the control device.

Preferably, the installation comprises a device for changing the code specific to the generator-control device connection, which is actuated when a new generator-control device couple is set up. At this point, the control device is no longer conditioned to control another generator.

Advantageously, the changing device is a device for adding a given number to the preceding code.

According to one embodiment of the invention, the generator and the control device are provided with connectors which may be connected via a cable for the initial communication of the two codes between the generator and the control device. This cable is provided solely for the initial communication: it may be simple and very short and it does not in any way reduce the advantages of the radio relay connection according to the invention.

Preferably, the generator-control device assembly comprises a pairing member which actuates the device for changing the code specific to the generator-control device connection.

According to one embodiment of the invention, the pairing member is actuated automatically when the control device is placed close to the local control device of the generator.

Advantageously, the generator and the control device are equipped with means for also recording and transmitting a code specific to the control device.

According to one preferred embodiment of the invention, the generator and its control device are equipped with means for rendering ineffective any communication except for the initial transmission after a new generator-control device couple has been set up if the said communication does not comprise the last codes recorded.

Preferably, the first transmission of the two codes comes from the generator. Specifically, this is the safest error-free way of recording the generator code, which may be placed in the memory of this generator from the time of its manufacture.

Advantageously, the control device is equipped, a short distance away, with a detector for measuring the magnitude of the radiation reaching it. Preferably, a detector in the form of a Geiger counter will be used.

According to one embodiment of the invention, the detector comprises an alarm which is designed to intervene when the dose of radiation received exceeds a warning level.

Preferably, the said detector is connected to means for emitting a signal which causes the generator to be switched off.

The present invention may be advantageously applied in both medical and industrial ionizing radiation uses. It makes it possible to dispense with any electrical or mechanical connection between the generator and its control device, except in certain cases (essentially to set up the initial codes at the time of pairing).

DESCRIPTION OF A PREFERRED EMBODIMENT OF THE INVENTION

FIG. 1 very schematically represents the set of means allowing the control and safety of an X-ray generator.

The control device or remote-control device 1 is the place at which the operator is positioned and intervenes to control the X-ray generator 2. The operator has a screen 3 on which appear the various measurements taken in particular by the X-ray detector 4, which is this case is a Geiger counter, which informs him of the dose of radiation he is receiving, warns him if the dose becomes high or hazardous and, via a switch-off apparatus 13 of the control device 1, switches off the generator by override when the dose exceeds a critical level. As a result, it is impossible in particular for the generator to function if the control device 1 is too close to the generator 2.

The control device 1 communicates with the generator 2 by means of a radio relay via the radio transmitters 5 and 6. This communication takes place in both directions, firstly to control the generator and secondly to transmit data from the generator to the control device 1 and the screen 3.

The generator 2 may comprise not only the generator itself, but also, nearby, the local control device 7 which contains the power supply for the generator itself and the various electrical members which do not necessarily need to be located in the place at which the radiation is produced.

The control device 1 and the local control device 7, which preferably comprise microprocessors or microcontrollers, contain memories 10, 11 in which the codes as described above are recorded. These codes are used at each transmission, irrespective of the direction of this transmission, between the control device 1 and the generator 2. The code specific to the connection is incremented at each new passage, that is to say when the generator is combined with a new control device. Instead of incrementation, a random code may also be used each time.

The pairing is brought about either by a manual action or by a contact acting when the control device 1 is placed next to or on the local control device 7, or by placing a cable 12 (indicated in a dashed line) between connectors or pairing members 8, 9 of these two devices, the said cable 12 being used only for the pairing. It is via this cable 12 that the codes are transmitted to the control device during the pairing.

The manufacturing number of the generator or the most distinctive portion of this number is used as the generator code, for example. The two codes are transmitted at the start of a message and the device which receives the message first checks the codes to ensure that the message is intended for this device.

When a control device 1 is changed, for example following the installation of the generator at another work site, a new pairing is carried out and the code specific to the connection is incremented using a code changing device 14. The old control device, which may also be at the same work site connected to another generator, can no longer control the previous generator since the code has been changed.

What is claimed is:

1. A method of controlling an ionizing radiation generator installation comprising an ionizing radiation generator, a local control device coupled to the ionizing radiation generator, a remote-control device configured to communicate with the local control device via a radio relay connection, the method comprising:

transmitting a recognition code specific to the generator between the local control device and the remote-control device; and transmitting a connection specific recognition code between the local control device and the remote-control device for each connection between the local control device and the remote-control device, wherein the local control device initially and automatically communicates the recognition code and the connection specific recognition code to the remote-control device when the remote-control device is initially assigned to control the ionizing radiation generator.

2. The method according to claim 1, further comprising changing the connection specific recognition code each time the generator is paired with another remote-control device.

3. The method according to claim 2, wherein changing the connection specific code involves carrying out a predetermined mathematical rule.

4. The method according to claim 3, wherein the predetermined mathematical rule comprises adding a predetermined number to the connection specific code.

5. The method according to claim 1, wherein the connection specific code comprises a variable portion and a fixed portion specific to the remote-control device.

6. The method according to claim 1, further comprising generating a control signal when the remote-control device is placed close to the local control device of the generator.

7. The method according to claim 6, further comprising connecting the remote-control device to the local control device of the generator.

8. The method according to claim 1, further comprising disabling radio communications between the generator and the remote-control device if the codes do not match the codes established when the remote-control device was initially assigned to control the ionizing radiation generator.

9. The method according to claim 1, further comprising measuring a magnitude of ionizing radiation close to the remote-control device.

10. The method according to claim 9, further comprising generating a warning signal when the magnitude of ionizing radiation exceeds a predetermined warning level.

11. The method according to claim 9, further comprising switching the generator off when the magnitude of ionizing radiation reaches a hazard level.

12. The method according to claim 1, wherein the radio relay connection between the generator and the control device is maintained at all times while the generator is working.

13. The method according to claim 1, further comprising stopping the generator to emit radiation and placing the generator in a safe mode if the radio relay connection between the generator and the control device is interrupted.

14. An ionizing radiation generator installation, comprising:

an ionizing radiation generator; and a remote-control device, wherein the generator and the control device are each equipped with a radio transmitter configured for radio communications via a radio relay connection, and with a memory for recording a generator code and a code specific to a connection between the remote-control device and the generator.

15. The installation according to claim 14, further comprising a changing device configured to change the code specific to the connection between the generator and the remote-control device, wherein the changing device is activated when the remote-control device is initially assigned to control the generator.

16. The installation according to claim 15, wherein the changing device is configured to add a predetermined number to the connection specific code.

17. The installation according to claim 15, wherein the generator and the control device are provided with connectors configured to connect to a cable for an initial communication of the two codes between the generator and the remote-control device.

18. The installation according to claim 15, wherein the generator and the remote-control device each comprise a pairing member which actuates the changing device.

19. The installation according to claim 18, wherein the pairing member is actuated automatically when the remote-control device is placed close to the generator.

20. The installation according to claim 14, wherein the generator and the remote-control device are configured to store and transmit a code specific to the remote-control device.

21. The installation according to claim 14, wherein the generator and the remote-control device are configured to disable any communication if the communication does not comprise previously recorded codes.

22. The installation according to claim 14, wherein a first transmission of the two codes originates from the generator.

23. The installation according to claim 14, wherein the remote-control device comprises a radiation measuring device which measures a magnitude of ionizing radiation.

24. The installation according to claim 23, wherein the radiation-measuring device includes a Geiger counter.

25. The installation according to claim 23, wherein the radiation measuring device generates an alarm when the magnitude of ionizing radiation exceeds a predetermined level.

26. The installation according to claim 23, wherein the radiation measuring device is connected to an apparatus configured to cause the generator to be switched off.

27. A method of controlling an ionizing radiation generator associated with a remote-control device, the method comprising:

initially and automatically transmitting a recognition code specific to the generator and a connection specific recognition code to the remote-control device via a radio connection; receiving the two codes in the remote-control device; and establishing a radio relay connection between the radiation generator and the remote-control device.

28. The method according to claim 27, wherein the radiation generator comprises a local control device that initially and automatically transmits the two codes.

* * * * *